US007793444B2

(12) United States Patent
Jones

(10) Patent No.: US 7,793,444 B2
(45) **Date of Patent: *Sep. 14, 2010**

(54) WEAR EDGE ASSEMBLY

(75) Inventor: Larren F Jones, Beaverton, OR (US); Dan Jones, legal representative, Beaverton, OR (US)

(73) Assignee: ESCO Corporation, Portland, OR (US)

( * ) Notice: Subject to any disclaimer, the term of this patent is extended or adjusted under 35 U.S.C. 154(b) by 832 days.

This patent is subject to a terminal disclaimer.

(21) Appl. No.: 11/529,447

(22) Filed: Sep. 28, 2006

(65) Prior Publication Data

US 2007/0022640 A1 Feb. 1, 2007

Related U.S. Application Data

(62) Division of application No. 10/812,348, filed on Mar. 30, 2004, now abandoned.

(51) Int. Cl.
*E02F 9/28* (2006.01)

(52) U.S. Cl. ..... 37/456; 37/455; 37/453

(58) Field of Classification Search ..... 37/446–460
See application file for complete search history.

(56) References Cited

U.S. PATENT DOCUMENTS

| | | | |
|---|---|---|---|
| 775,770 | A | 11/1904 | Herrod, Jr. |
| 1,031,138 | A | 7/1912 | McKee et al. |
| 1,076,548 | A | 10/1913 | Butler |
| 1,485,243 | A | 2/1924 | Blake |
| 1,775,984 | A | 9/1930 | Younie |
| 1,885,326 | A | 11/1932 | Brune |
| 1,959,847 | A | 5/1934 | Buskirk |
| 1,992,591 | A | 2/1935 | Whisler |
| 2,870,667 | A | 1/1959 | Murtaugh |
| 2,996,291 | A | 8/1961 | Krekeler |
| 3,160,967 | A | 12/1964 | Nichols |
| 3,171,500 | A | 3/1965 | Dils, Jr. |
| 3,345,765 | A | 10/1967 | Petersen |
| 3,357,117 | A | 12/1967 | Petersen |
| 3,371,437 | A | 3/1968 | Wilson et al. |
| 3,388,488 | A | 6/1968 | Duplessis |
| 3,413,739 | A | 12/1968 | Guinot |
| 3,426,459 | A | 2/1969 | Petersen |

(Continued)

FOREIGN PATENT DOCUMENTS

WO WO 02/12642 2/2002

OTHER PUBLICATIONS

ESCO Brochure; "Instructions for T4-V71, T4L-V71, & T4R-V&1 Toplok® Adapters", M/LMS-504-0302, 2002, pp. 1-8.

(Continued)

*Primary Examiner*—Thomas A Beach
(74) *Attorney, Agent, or Firm*—Steven P. Sched

(57) ABSTRACT

A wear assembly for protecting a structure, such as an excavating bucket, from wear includes a lock for securing the wear member in place. The lock includes a take-up element for tightening the fit of the wear member, a latch to retain the lock in the assembly during use, and an arrangement for resisting loosening of the lock. With the assembly, the lock is able to effectively tighten the fit of the wear member on the lip, resist loosening of the fit, and facilitate easy removal of the lock without a concomitant increased risk of lock ejection.

16 Claims, 14 Drawing Sheets

U.S. PATENT DOCUMENTS

| | | | | | |
|---|---|---|---|---|---|
| 3,497,973 | A | | 3/1970 | Campbell | |
| 3,537,735 | A | | 11/1970 | Hawk | |
| 3,621,594 | A | | 11/1971 | Hahn et al. | |
| 3,685,177 | A | | 8/1972 | Hahn et al. | |
| 3,708,895 | A | | 1/1973 | Griffith et al. | |
| 3,736,664 | A | | 6/1973 | Black et al. | |
| 3,762,079 | A | | 10/1973 | Lukavich et al. | |
| 3,841,007 | A | | 10/1974 | Howarth et al. | |
| 3,851,413 | A | | 12/1974 | Lukavich | |
| 3,864,853 | A | | 2/1975 | Klett et al. | |
| 3,896,569 | A | | 7/1975 | Thompson et al. | |
| 3,919,792 | A | | 11/1975 | Hahn et al. | |
| 3,947,982 | A | | 4/1976 | Mantovani | |
| 3,974,579 | A | | 8/1976 | Black et al. | |
| 3,995,384 | A | | 12/1976 | Wood | |
| 4,006,544 | A | | 2/1977 | Stepe | |
| D245,780 | S | | 9/1977 | Dahlberg et al. | |
| 4,103,442 | A | | 8/1978 | Zept | |
| 4,129,934 | A | | 12/1978 | Gettman | |
| 4,205,469 | A | | 6/1980 | Johansson et al. | |
| 4,233,761 | A | | 11/1980 | Ryerson | |
| 4,267,653 | A | | 5/1981 | Hahn et al. | |
| 4,271,615 | A | | 6/1981 | Jones | |
| 4,290,214 | A | | 9/1981 | Stepe | |
| 4,317,300 | A | | 3/1982 | Emrich et al. | |
| 4,335,532 | A | | 6/1982 | Hahn et al. | |
| 4,373,831 | A | | 2/1983 | Crawford | |
| 4,404,760 | A | | 9/1983 | Hahn et al. | |
| 4,414,764 | A | | 11/1983 | Johansson et al. | |
| 4,433,496 | A | | 2/1984 | Jones et al. | |
| 4,449,309 | A | | 5/1984 | Hemphill | |
| 4,457,380 | A | | 7/1984 | Curry | |
| 4,501,079 | A | | 2/1985 | Hahn et al. | |
| 4,570,365 | A | | 2/1986 | Bierwith | |
| 4,577,423 | A | | 3/1986 | Hahn | |
| 4,626,034 | A | | 12/1986 | Breuer et al. | |
| 4,716,667 | A | | 1/1988 | Martin | |
| 4,748,754 | A | | 6/1988 | Schwappach | |
| RE33,042 | E | | 9/1989 | Emrich | |
| 4,899,830 | A | | 2/1990 | Maguina-Larco | |
| 4,932,145 | A | * | 6/1990 | Reeves, Jr. | 37/451 |
| 4,932,478 | A | | 6/1990 | Jones | |
| 4,965,945 | A | | 10/1990 | Emrich | |
| 5,005,304 | A | | 4/1991 | Briscoe et al. | |
| 5,016,365 | A | | 5/1991 | Robinson | |
| 5,052,134 | A | | 10/1991 | Bierwith | |
| 5,056,243 | A | | 10/1991 | Sprunger et al. | |
| 5,063,695 | A | | 11/1991 | Briscoe et al. | |
| 5,063,696 | A | | 11/1991 | Smith | |
| 5,068,986 | A | * | 12/1991 | Jones | 37/457 |
| 5,075,986 | A | | 12/1991 | Smith et al. | |
| 5,088,214 | A | | 2/1992 | Jones | |
| 5,241,765 | A | | 9/1993 | Jones et al. | |
| 5,283,965 | A | | 2/1994 | Clendenning | |
| 5,325,615 | A | | 7/1994 | Hutchins et al. | |
| 5,337,495 | A | | 8/1994 | Pippins | |
| 5,396,964 | A | | 3/1995 | Shellhorn et al. | |
| 5,410,826 | A | | 5/1995 | Immel et al. | |
| 5,412,885 | A | * | 5/1995 | Cornelius | 37/451 |
| 5,417,518 | A | | 5/1995 | Bierwith | |
| 5,438,774 | A | | 8/1995 | Fletcher et al. | |
| 5,452,529 | A | | 9/1995 | Neuenfeldt et al. | |
| 5,553,409 | A | | 9/1996 | Irving | |
| 5,564,508 | A | | 10/1996 | Renski | |
| 5,634,285 | A | | 6/1997 | Renski | |
| 5,653,048 | A | | 8/1997 | Jones et al. | |
| 5,713,145 | A | | 2/1998 | Ruvang | |
| 5,802,752 | A | | 9/1998 | Quarfordt | |
| 5,806,216 | A | | 9/1998 | Renski | |
| 5,852,888 | A | | 12/1998 | Cornelius | |
| 5,937,549 | A | | 8/1999 | Bender et al. | |
| 5,983,534 | A | | 11/1999 | Robinson | |
| 5,992,063 | A | | 11/1999 | Mack | |
| 6,145,224 | A | * | 11/2000 | Stickling | 37/458 |
| 6,151,812 | A | | 11/2000 | Bierwith | |
| 6,194,080 | B1 | | 2/2001 | Stickling | |
| 6,209,238 | B1 | | 4/2001 | Ruvang | |
| 6,393,739 | B1 | | 5/2002 | Shambin et al. | |
| 6,725,582 | B2 | * | 4/2004 | Adamic et al. | 37/456 |
| 6,729,052 | B2 | | 5/2004 | Ollinger et al. | |
| 6,848,203 | B2 | * | 2/2005 | Hohmann et al. | 37/446 |
| 7,299,570 | B2 | * | 11/2007 | Emrich et al. | 37/455 |
| 2008/0092412 | A1 | * | 4/2008 | McClanahan et al. | 37/451 |

OTHER PUBLICATIONS

ESCO Booklet; "ESCO Toplok Adapter System for Plate Lips", Mining College '97, DMC Sep. 9, 1997, Illustrations 1-23.

Clark Equipment, Bucket Tooth Adapter Installation Drawing, No. 1546546, Mar. 13, 1970.

* cited by examiner

WEAR EDGE ASSEMBLY

The present application is a divisional of co-pending U.S. patent application Ser. No. 10/812,348 filed Mar. 30, 2004.

FIELD OF THE INVENTION

The present invention pertains to a wear assembly for protecting a structure subjected to an abrasive environment. In a preferred construction, the inventive wear assembly is particularly suited for protecting the digging edge of an excavator, such as an excavating bucket.

BACKGROUND OF THE INVENTION

Excavating buckets and other excavating equipment are typically subjected to harsh conditions. A series of wear members are usually provided to protect the digging edge and other portions of the bucket from premature wear. Wear members have in the past been secured to the bucket in many different ways.

For example, in U.S. Pat. No. 4,570,365 to Bierwith, the wear members are secured to the lip of the bucket through the use of a wedge and spool lock arrangement that is fit through a hole in the lip spaced from the front edge. In this arrangement, the spool pinches the rear ends of the wear member against the inner and outer faces of the lip as the wedge is driven into the hole. However, under load, the legs of the wear member can shift and cause loosening of the lock and possible loss of the wear member. In addition, the formation of a hole in the lip weakens the lip and lessens its ability to effectively resist large loads as it is forced into the ground.

In U.S. Pat. No. 4,748,754 to Schwappach, a lateral boss is welded to the inner face of the tip as a support for holding the wear member to the lip. The wear member has a rearwardly extending leg provided with an opening into which the boss is received. A lock composed of a pair of opposed, generally C-shaped securing members joined by a central elastomer is placed in the opening between the boss and the end of the leg. The elastomer expands to fill the opening and provide some tightening of the assembly. However, the elastomer does not possess sufficient strength for the lock to well withstand the expected loads. Hence, the wear member can shift during use, which may result in ejection of the lock and loss of the wear member.

U.S. Pat. No. 5,088,214 to Jones discloses a wear assembly wherein a longitudinal boss is fixed to the lip for receipt in a corresponding slot defined in the wear member. A hole is formed in the wear member to receive and position a lock against the rear end of the boss to hold the wear member to the lip. The lock is a rigid, block-shaped member that provides firm resistance to the applied loads. While the use of a rigid member instead of an elastomeric body avoids overloading the lock during use, it does not provide any ability to tighten the mounting of the wear member on the lip.

U.S. Pat. No. 5,653,048 to Jones et al. discloses a lock with a rigid body and a threaded plug to tighten the wear member onto the lip. However, the threaded plug can loosen during use in some circumstances due to vibration and impact forces. Moreover, the lateral latch construction used in both this patent as well as the '214 patent, can at times be difficult to release on account of fines being impacted in the expansion space for the elastomer.

Accordingly, there is a need for an improved assembly for attaching a wear member to the digging edge of an excavator that avoids the problems of the prior art.

SUMMARY OF THE INVENTION

The present invention pertains to an improved assembly for securing a wear member to a structure subjected to wear in an abrasive environment. In a preferred construction, the wear member protects the front digging edge of an excavating bucket.

In one aspect of the invention, the wear assembly includes a lock for securing the wear member in place that is provided with improved means for tightening the fit of the wear member onto the lip and retaining the lock in the assembly during use. With the improved means, the lock is able to effectively tighten the fit of the wear member on the Lip, resist loosening of the fit, and facilitate easy removal of the lock without a concomitant increased risk of lock ejection.

In accordance with one aspect of the invention, the lock has a threaded take-up element that tightens the wear member onto the lip and includes means to inhibit loosening during use. A tighter fit results in reduced wear in the components. In one preferred embodiment, the take-up element includes a threaded member and a resilient member. The resilient member resists loosening of the threaded member and applies an expanding force that continues to tighten the fit of wear member on the protected structure even after wear begins to develop in the components. In addition, the threaded member provides a firm stop that resists overloading and lock ejection. In another construction, a threaded take-up member has an area of deformed threads to prevent inadvertent loosening of the take-up element.

In accordance with another aspect of the present invention, an arcuate path is used to effectively retain the lock and yet stilt permit easy release when replacement of the wear member is needed. In one embodiment, a lock body defines an arcuate path for receipt of a resilient latch member. The arcuate path enables the latch to be retracted into an open space free of impacted fines. In another embodiment, the wear member defines an arcuate path for receipt of an arcuate lock. The arcuate path inhibits pin ejection, but still permits easy removal of the lock with a hammer.

In accordance with another aspect of the invention, the lock utilizes a resilient take-up element and a resilient latch in a construction that provides continued tightening without an increased risk of lock ejection. In one embodiment, an arcuate lock is fit in an arcuate path. The lock includes an elastomeric body as the take-up element to tighten the wear member on the lip. In this way, the elastomeric body can apply a continued tightening force, and the rigid lock body in the arcuate path inhibits pin ejection.

In accordance with another aspect, a shroud or other wear member adapted to overlie the front digging edge of a bucket lip includes an arcuate passage which opens on both ends in an upper, exterior surface of the wear member for receiving a lock. The elimination of a large opening for receiving the lock increases the strength of the wear member. Moreover, the arcuate passage facilitates easy insertion and removal of the Lock with a hammer.

DETAILED DESCRIPTION OF THE PREFERRED EMBODIMENTS

The present invention pertains to an assembly for securing a wear member to a structure subjected to an abrasive work environment. The inventive wear assembly is particularly suited for protecting an edge of a structure, such as a digging edge of an excavating bucket.

Figure 1:
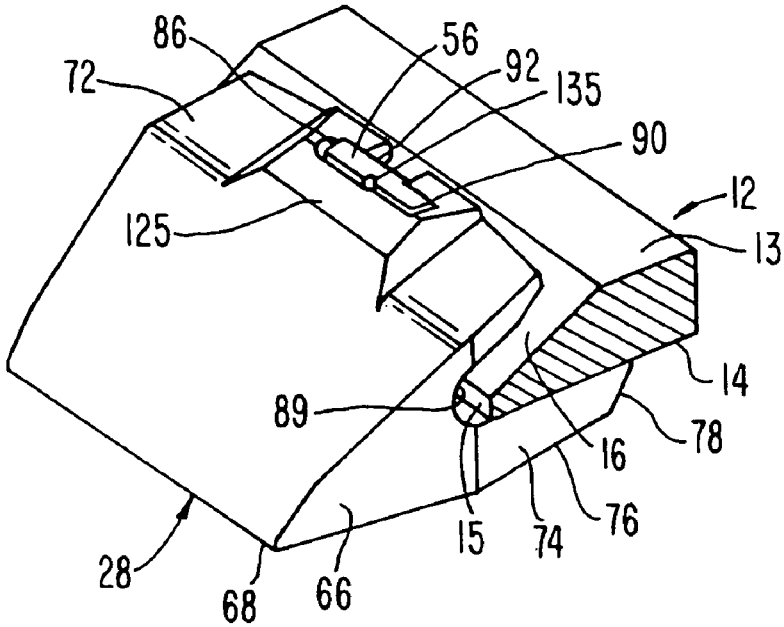
FIG. 1 is a front perspective view of a wear assembly in accordance with the present invention secured to a lip of an excavator.
Figure 2:
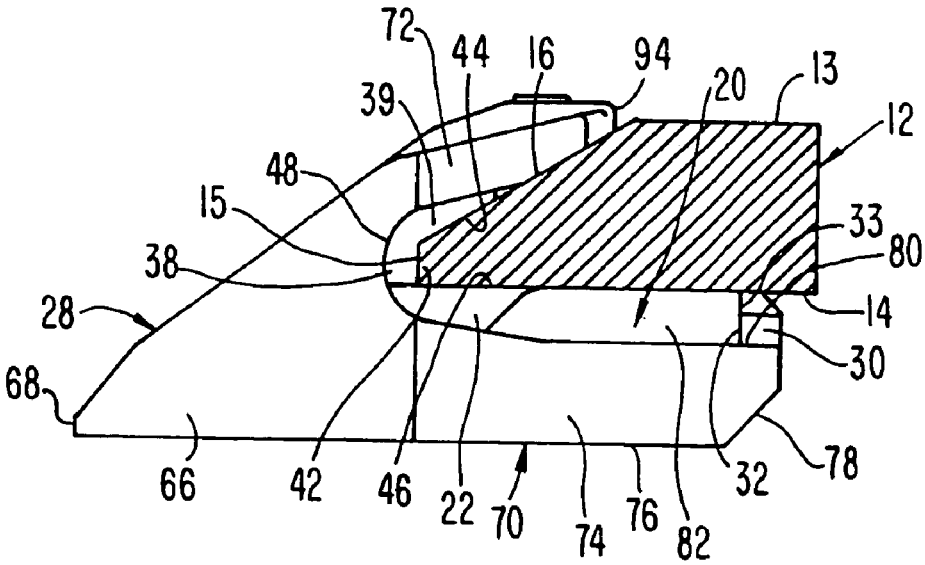
FIG. 2 is a side view of the wear assembly secured to the lip.
Figure 3:
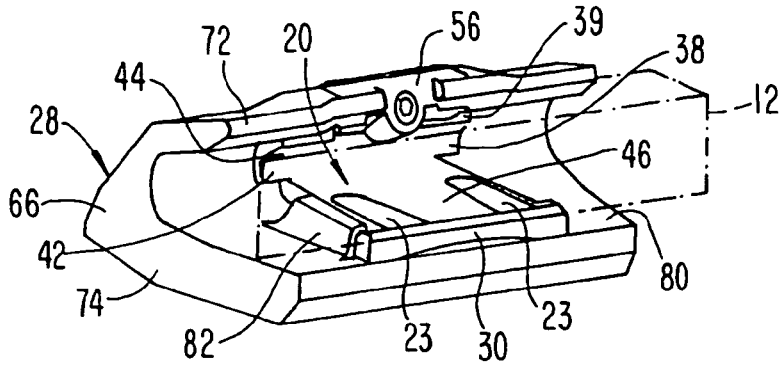
FIG. 3 is a rear perspective view of the wear assembly with the lip in phantom.

In a preferred construction, the wear member is a shroud that overlies and protects the front digging edge of an excavating bucket lip 12. The tip includes an inner face 13, an outer face 14 and a front edge face 15 (FIGS. 1 and 2). White the illustrated tip includes an interior ramp surface 16, the invention can be used with other kinds of lips. Moreover, the inventive concepts can be used to secure other kinds of wear members to other excavators.

The invention is at times discussed in terms of relative terms, such as up, down, vertical, horizontal, etc. for the sake of easing the description. These terms are to be considered relative to the orientation of the elements in FIG. 1 (unless otherwise noted), and are not to be considered limitations on the invention. As can be appreciated, the wear member can be used and oriented in a variety of ways.

Boss 20 has a body or first leg 22 extending along outer face 14 of lip 12 (FIGS. 2-5). While boss 20 is preferably welded to the lip, it could be formed (e.g., cast or forged) as an integral part of the lip or secured by mechanical means. In addition, the boss could each be formed as a multiple of parts, which are integral or spaced apart, although a one-piece member is preferred for simplicity and strength. In the preferred construction, body 22 includes holes 23 to facilitate welding of the boss to the lip. Welding is also preferably provided along selected portions of the periphery of the boss, such as along brace 30 and the inner or second leg 39.

Figure 4:
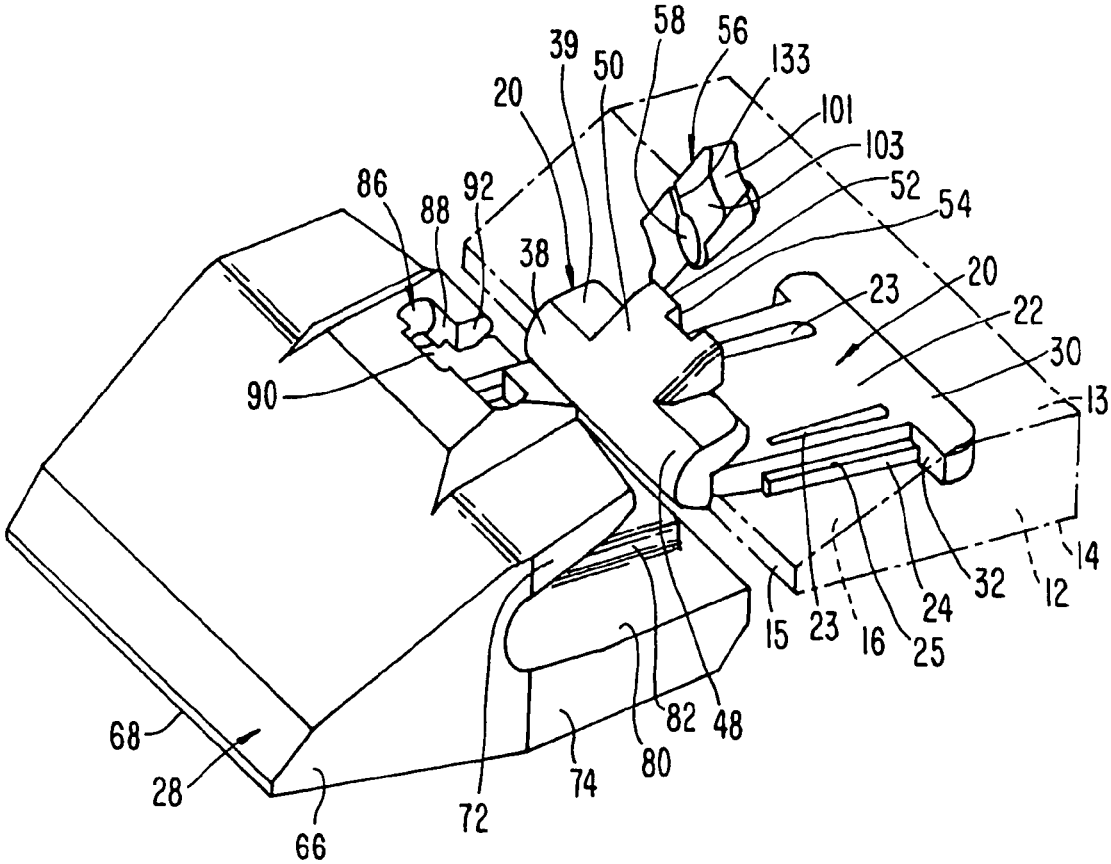
FIG. 4 is a front perspective, exploded view of the wear assembly on the lip with the lip shown in phantom.
Figure 5:
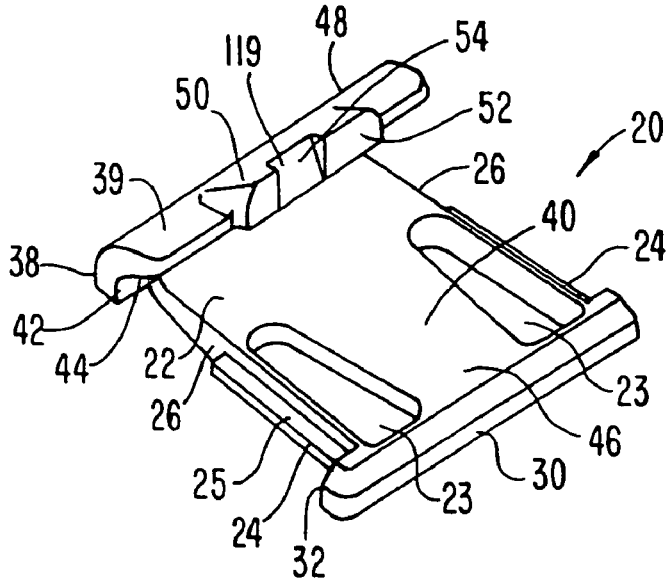
FIG. 5 is a rear perspective view of a boss of the wear assembly.

Body 22 preferably includes a pair of rails 24 extending along sidewalls 26 in a rearward direction from front edge 15 (FIGS. 4 and 5). The rails project laterally outward from each sidewall 26 to form a T-shaped cross-sectional configuration. Rails 24 have holding surfaces 25 that are spaced from and facing outer face 14. As discussed below, rails 24 cooperate with a wear member or (in this case) shroud 28 to prevent its movement away from the lip. While a T-shaped configuration is preferred, the rails could have other shapes, such as dovetail. Alternatively, the rails could be formed on the wear member 28 and the slot in boss 20.

A brace 30 preferably extends laterally across the rear end of body 22 (FIGS. 2-5). In the preferred construction, the rear ends of rails 24 are integrally fixed to brace 30 to additionally support the rails when under load (FIG. 4). Such support at the rear end of the rails is particularly advantageous in resisting vertical loads that tend to rotate or swing the wear member about the front digging edge of the lip. Brace 30 further extends outward of body 22 to define a stop surface 32 adapted to abut a rear end 33 of shroud 28 and thereby reduce the stress on the boss, which in turn, reduces the stress along front edge 15 of lip 12.

A front part 38 of boss 20 wraps around front edge 15 of lip 12 to define an inner leg 39 along the ramp surface 16. Front part 38 is preferably wider than body 22 to provide a larger surface area to contact shroud 28 and lip 12 (FIG. 5), but it could have the same or smaller width than the body. Inner surface 40 of boss 20 (i.e., the surface that faces lip 12) is shaped to conform to the shape of the particular lip to which it is fixed (FIGS. 2 and 5). In this case, the inner surface 40 includes a first portion 42 set against front edge 15, a second portion 44 set against ramp 16, and a third portion 46 set against outer face 14. As seen in FIG. 2, inner leg 39 preferably overlies only ramp surface 16 so that the boss is outside or below the inner face 13 to avoid impeding the gathering or dumping of the excavated material. However, other arrangements for attaching the boss are possible. For example, if the front of the lip has a curved or other shape, inner surface 40 would be changed to match the shape of the lip.

The front face 48 of boss 20 preferably has a uniform curved shape to provide a smooth surface without corners to act as a bearing face for shroud 28. In this way, the boss is able to provide a better bearing surface than the front of lip 12 with its relatively sharp and thinner front digging edge. Nevertheless, other shapes for front face 48 are possible. Alternatively, body 22 could be positioned within the bucket so that third portion 46 is fixed to inner face 13 instead of outer face 14.

Figure 8:
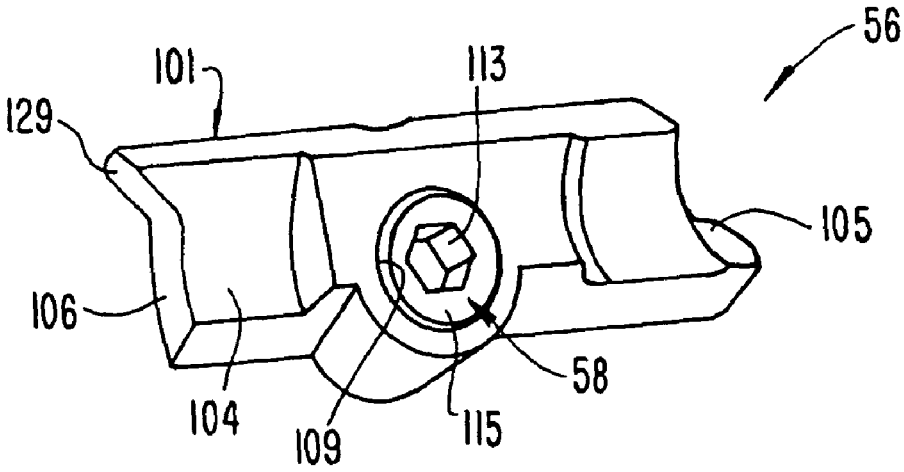
FIG. 8 is a rear perspective view of a lock of the wear assembly.
Figure 9:
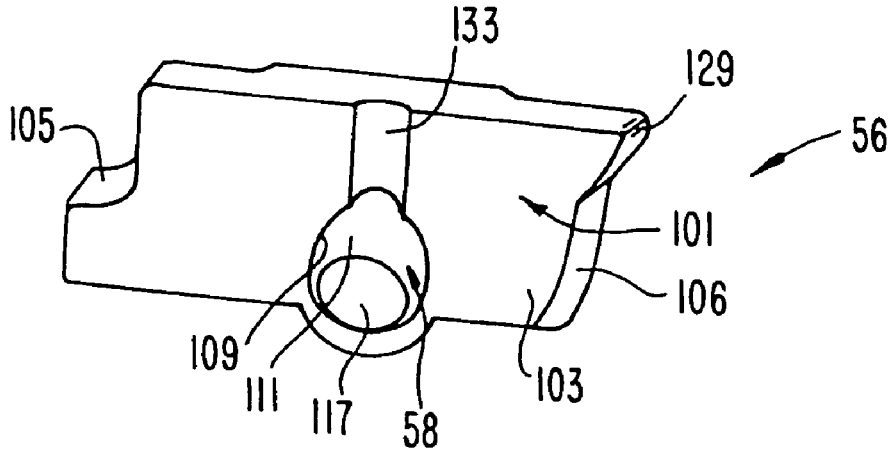
FIG. 9 is a front perspective view of the Lock.
Figure 10:
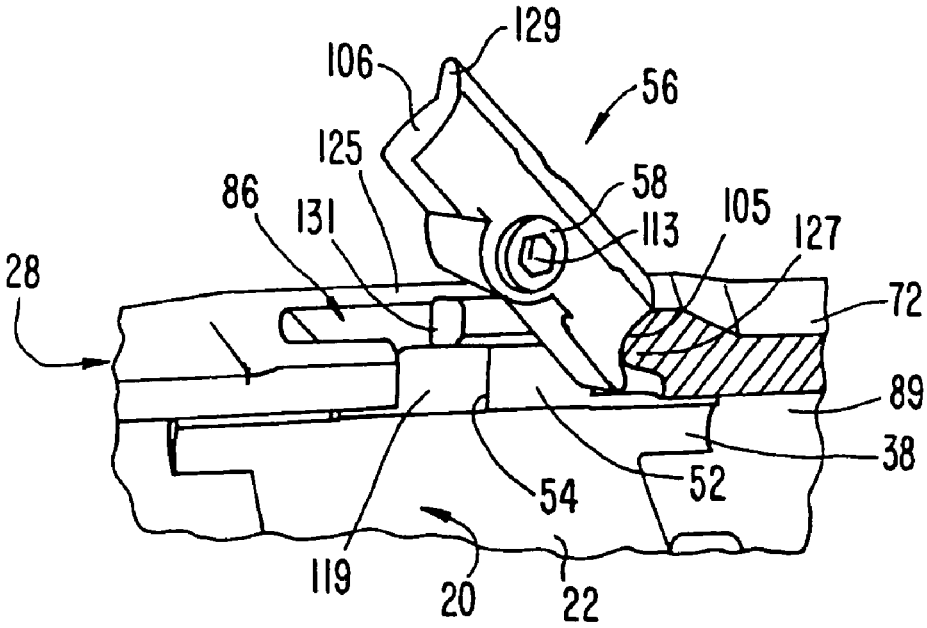
FIG. 10 is a partial rear perspective view, in partial cross section, of the wear assembly with the lock being inserted.
Figure 11:
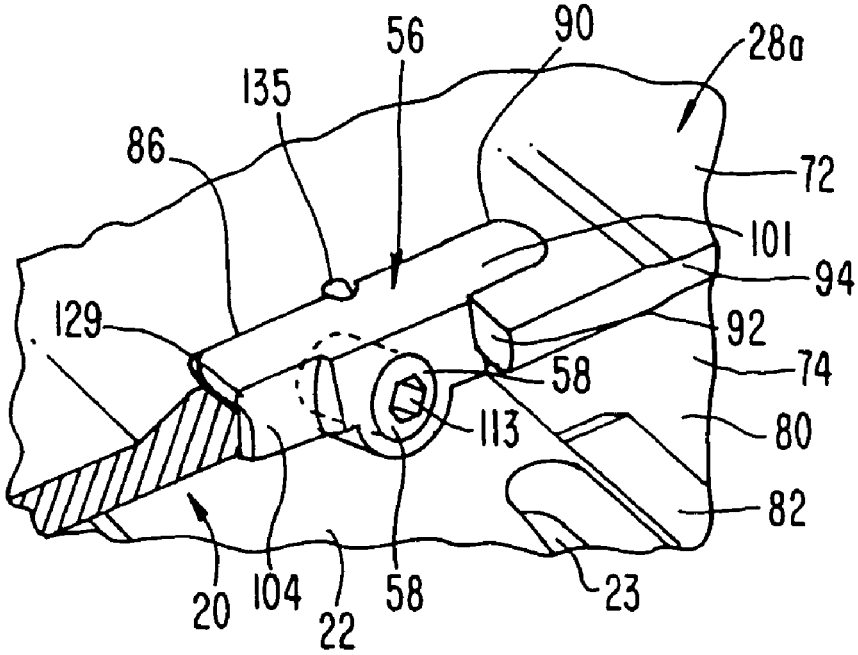
FIG. 11 is a partial rear perspective view, in partial cross section, of the wear assembly.

In the preferred construction, inner leg 39 includes a support 50, which projects outward to form an abutment for lock 56 (FIGS. 4 and 5). In particular, support 50 includes a rear wall 52 that defines an orthogonal wall to oppose lock 56. In one preferred construction, rear wall 52 includes a recess 54, preferably centrally located, to cooperate with a plug member 58 of the lock (FIGS. 8-10).

In the preferred construction, shrouds 28 have a front working portion 66 that tapers to a narrowed front edge 68, and a rear mounting portion 70 that is bifurcated to define an inner leg 72 and an outer leg 74 (FIGS. 1-4 and 6-7). Outer leg 74 has a generally flat outer face 76 and a rear deflector face 78 that is inclined forwardly away from lip 12 to direct any earthen material away from the wear member during reverse movement of the bucket. The inner face 80 preferably has a pair of dogleg flanges 82 that face inward to define a T-shaped slot 84 for receiving body 22 and rails 24. Flanges 82 could have different shapes to define a slot with a dovetail or other configuration to complement the shape of rails 24. Alternatively, the flanges could be replaced with a thicker outer leg that includes inner walls to form the slot receiving the boss 20. Also, the tongue and groove arrangement could be reversed so that the boss is formed to define the slot and the wear member a tongue received into the slot (not shown).

Figure 6:
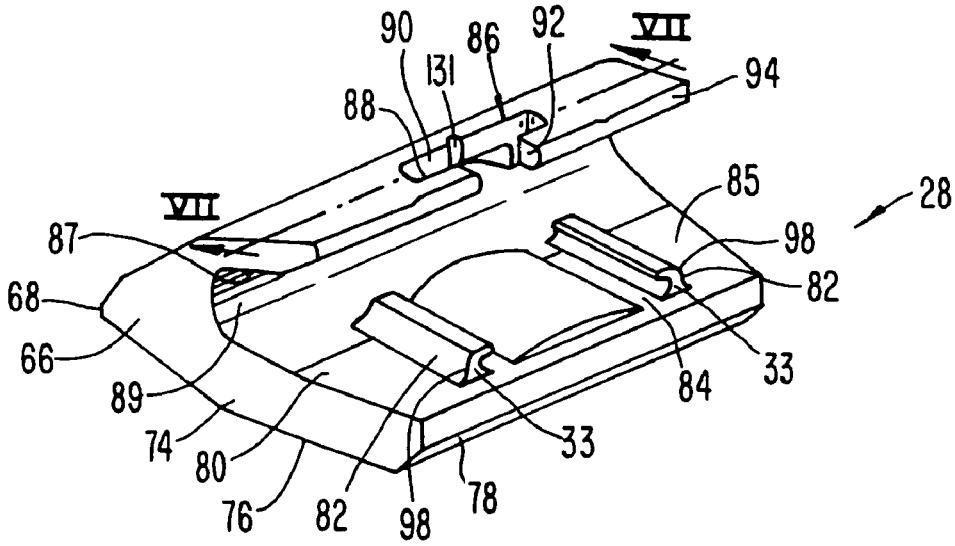
FIG. 6 is a rear perspective view of the wear member.
Figure 7:
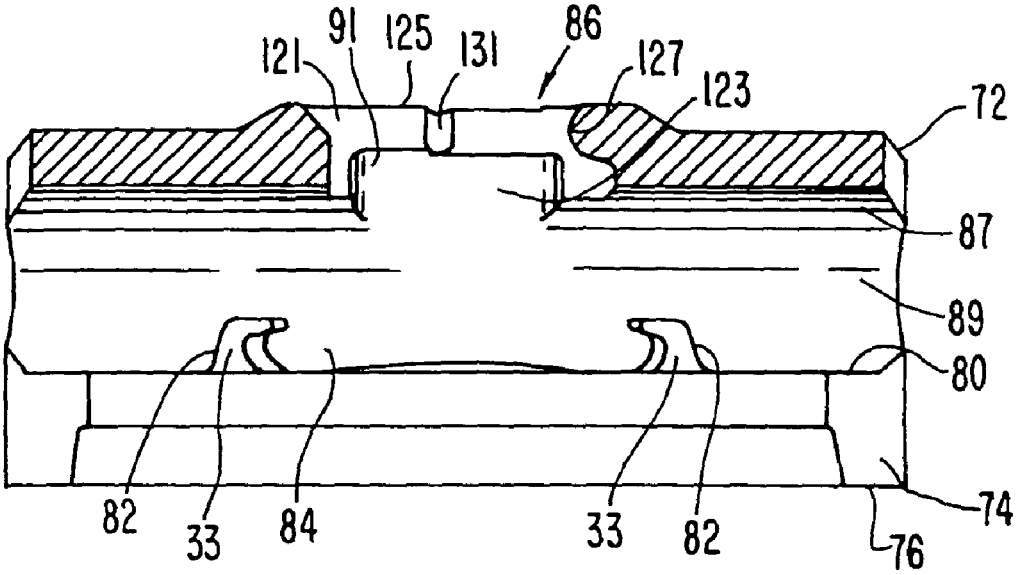
FIG. 7 is a rear view, in partial cross section along line VII-VII in FIG. 6, of the wear assembly.

Shroud 28 includes an inner surface 85 that includes inner face 80 of outer leg 74, inner face 87 of inner leg 72, and an inner corner surface 89 at the intersection of legs 72, 74 (FIGS. 6 and 7). Inner corner surface 89 has a shape that generally matches front face 48 of boss 20 and abuts against it. Accordingly, in the preferred embodiment, inner corner surface 89 has a generally uniform curved surface. When assembled, inner face 80 of outer leg 74 overlies body 22 and outer face 14, and inner face 87 of inner leg 72 overlies inner leg 39 of boss 20 and ramp surface 16 of lip 12. Inner leg 72 includes, along inner surface 87, a cavity 91 sized to receive support 50.

Inner leg 72 includes an aperture 86 adapted to receive lock 56 therein. In the preferred embodiment, aperture 86 has a main portion 90 having a generally rectangular configuration to match the shape of the preferred lock, though other shapes are possible, and a stem portion 92 that opens in the rear wall 94 of inner leg 72 to provide clearance for plug member 58 (FIGS. 4 and 6). The rear wall 88 of aperture 86 forms a bearing surface to each side of stem portion 92 to abut lock 56.

When shroud 28 is installed, it is slid over lip 12 such that inner and outer legs 72, 74 straddle the lip (FIGS. 1-4). Rails 24 of body 22 are fit within slot 84 as shroud 28 is moved rearward. The rearward movement is continued until inside corner surface 89 abuts front face 48 of boss 20. At this juncture, rear ends 33 of flanges 82 of outer leg 74 are preferably placed in close proximity to stop surface 32. With cast parts, it is not practical for inside corner surface 89 and rear ends 33 to simultaneously abut front face 48 and stop surface 32, respectively. However, by placing rear ends 33 in close proximity with stop surface 32, the two surfaces will typically abut after a short amount of time as wear develops in the parts to provide extra support for the loads applied to the shroud and provide enhanced protection for the lip.

In the preferred construction, lock 56 includes a body 101 having a generally parallelepiped configuration that corresponds to the shape of aperture 86 (FIGS. 8-11), though other shapes can be used. The body includes a front wall 103, a rear wall 104, and sidewalls 105, 106. A threaded bore 109 extends through body 101 and opens in front and rear walls 103, 104. Plug member 58 includes a threaded shank 111 to be threadedly received into bore 109, and a tool-engaging formation 113 on rear end 115. While in the preferred construction formation 113 is formed as a hex-shaped socket, the socket could have other shapes or be replaced with other kinds of flats adapted to cooperate with tools to effect turning of the plug. The front end 117 of plug 58 is adapted to project forward and abut bearing face 119 of boss 20 within recess 54. In this way, plug member 58 can be advanced so as to push against bearing face 119 of boss 20, which in turn, presses rear wall 104 of lock 56 against rear wall 88 of aperture 86. This movement of plug member 58, then, causes shroud 28 to be pushed tightly against front face 48 of boss 20. A tighter fit reduces the shifting of the shroud during use, which will in turn reduce the amount of wearing among the components.

When shroud 28 is fit onto lip 12, the front wall 121 of aperture 86 is generally aligned with rear wall 52 of support 50, though it could also be spaced rearward thereof, to permit lock 56 to fit within aperture 86 and be rearward of support 50. In this way, front wall 103 opposes rear wall 52 of support 50 and front wall 121 of aperture 86. Further, the recessed wall 119 in recess 54 sets underneath a midsection 125 of inner leg 72 of shroud 28, i.e., forward of aperture 86 (FIGS. 5 and 10). Accordingly, as plug member 58 is advanced to engage recessed wall 119, it extends underneath midsection 125. In this way, plug member 58 not only functions as a take up member to tighten the fit of the shroud against the boss, it also functions as a latch to hold the lock in aperture 86. Moreover, since the rear end 115 of plug member 58 sets within stem portion 92 (which can be easily cleared) the plug member can be easily retracted to remove the lock without concern over impacted fines blocking the movement.

In the preferred construction, one sidewall 105 of lock body 101 has an arcuate shape to fit against an arcuate sidewall 127 of aperture 86 so that the lock can be easily swung into aperture 86 (FIG. 10). The opposite sidewall 106 preferably includes a laterally projecting tang 129 to ease removal of lock 56 from aperture 86. Of course, lock body 101 could omit these features or have other shapes.

In the preferred construction, front wall 103 of lock 56 and front wall 121 of aperture 86 each includes a channel 131, 133 that are aligned to form a passage 135 extending through inner leg 72 of shroud 28. The passage is sized to permit insertion of a punch or other slender tool (not shown). The punch is hammered against the threads of plug member 58 adjacent front wall 103 of lock 56 to peen the threads and prevent inadvertent loosening during use of the excavator. Of course, passage 135 could be defined in other ways. Also, the peening does not prevent intentional withdrawal of the plug member through the use of a wrench.

In use, shroud 28 is slid onto boss 20 with the body 22 fit within slot 84 until inner corner surface 89 abuts front face 48. The front face of the boss is narrower than the shroud and preferably fits into a recess in the shroud as disclosed in co-pending U.S. patent application Ser. No. 10/425,605, filed Apr. 30, 2003, which is herein incorporated by reference in its entirety. As seen in FIG. 2, neither shroud 28, boss 20 nor lock 56 project into the excavator, i.e., above inner face 13. Accordingly, the assembly does not hinder the gathering or dumping of the load. Once the shroud is fully pushed onto the lip, aperture 86 is generally positioned just rearward of rear wall 52 of support 50. With plug member 58 generally flush or rearward of front wall 103, arcuate sidewall 105 is set against curved sidewall 127 and lock 56 swung downward into aperture 86. A wrench or other tool is then used to turn plug member 58 to advance the plug member beneath midsection 125 and against recessed wall 119. Advancement of the plug continues to pull shroud 28 tightly against front face 48. Once the plug has been fully advanced, a punch is slid into passage 135 and hammered against the threads of plug 58 adjacent front wall 103 of lock 56 to deform an area of the threads and prevent undesired loosening during use.

Alternatively, a second lock 140 can be used to hold shroud 28*a* to boss 20 (FIGS. 12-16). Shroud 28*a* is the same as shroud 28 except where disclosed as being different. Accordingly, the same reference numerals are used for like parts.

Figure 12:
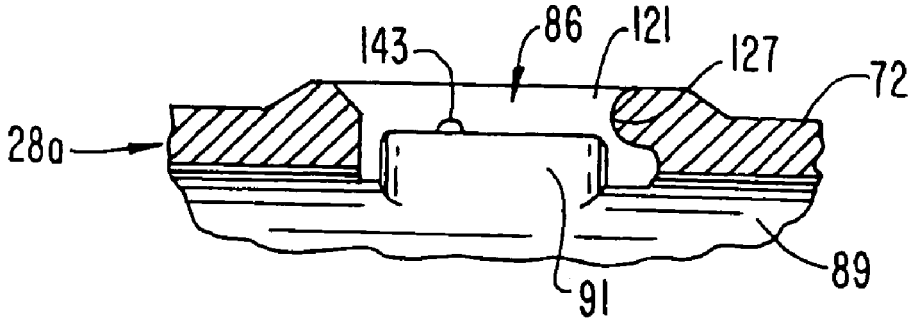
FIG. 12 is a partial rear view of the wear member of a second embodiment.
Figure 13:
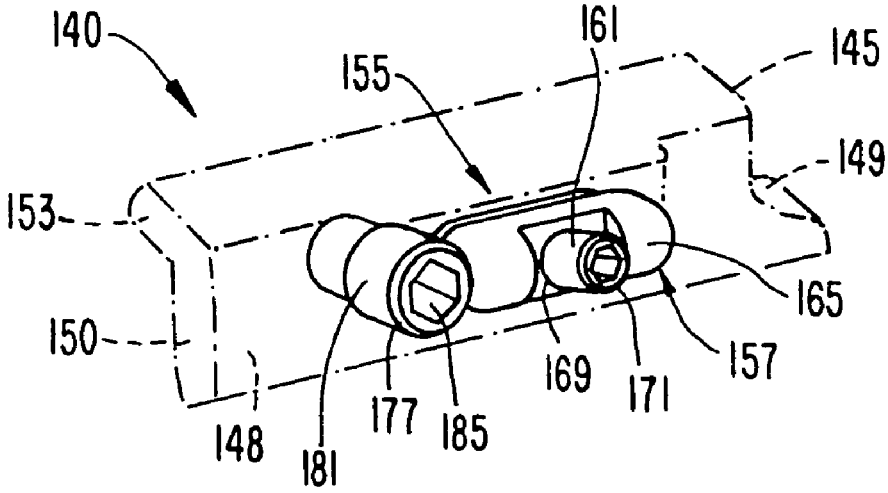
FIG. 13 is a rear perspective view of a second embodiment of a lock in accordance with the present invention with the lock body shown in phantom.
Figure 14:
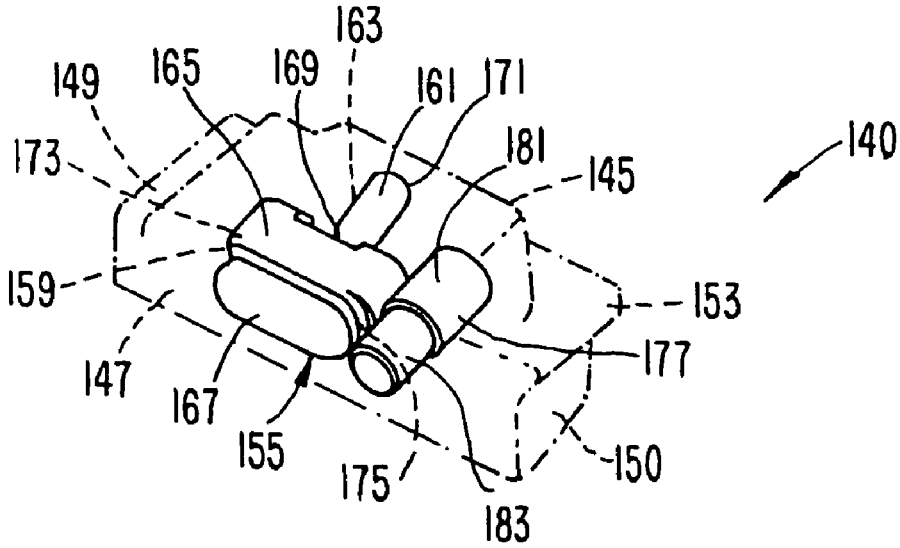
FIG. 14 is a front perspective view of the second embodiment of the lock with the lock body shown in phantom.

In this arrangement, front wall 121 of aperture 86 preferably includes a depression 143 instead of channel 131 (FIG. 12). Otherwise, the construction of the components is the same. Lock 140 has a body 145 preferably having generally a parallelepiped shape with a front wall 147, a rear wall 148, and sidewalls 149, 150 (FIGS. 13-14). As with lock 56, sidewall 149 has a concave, arcuate shape to pivot about sidewall 127, and a tang 153 to ease removal of the lock.

Lock 140 further includes a take-up assembly 155 comprising a plug 157 received in a pocket 159 in front wall 147, and a threaded pusher 161 received in a threaded bore 163 extending inward from rear wall 148. Bore 163 connects with pocket 159 so that pusher 161 engages plug 157. Plug 157 includes an elastomeric body 165 preferably composed of rubber or other resilient material, and a shell 167 composed of steel or other hard material preferably bonded to the elastomeric body by molding or adhesive. The elastomeric body 165 fits within a rear portion 173 of pocket 159, which is slightly larger than opening 175 in front wall 147; that is, the elastomeric body is compressed to fit within opening 175 and then expands into rear portion 173 to hold plug 157 within lock body 145. Rear portion 173, however, is Longer (front to back) to permit axial movement of the elastomeric body. Pusher 161 consists of a threaded shank having a blunt forward end 169 to engage elastomeric body 165, and a rear end 171 provided with a hex socket or other wrench-engaging formation 172.

Figure 15:
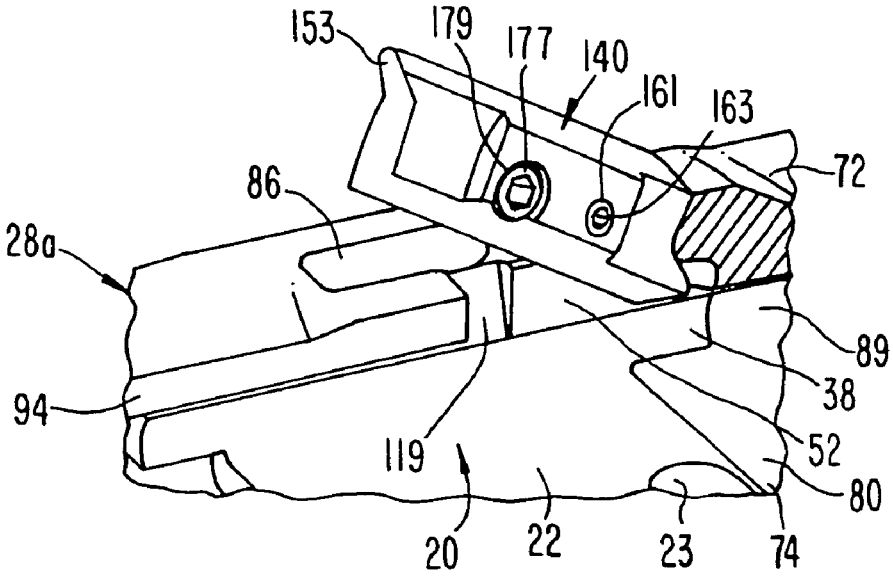
FIG. 15 is a partial rear perspective view, in partial cross section, of the second embodiment of the lock being inserted into the wear assembly.
Figure 16:
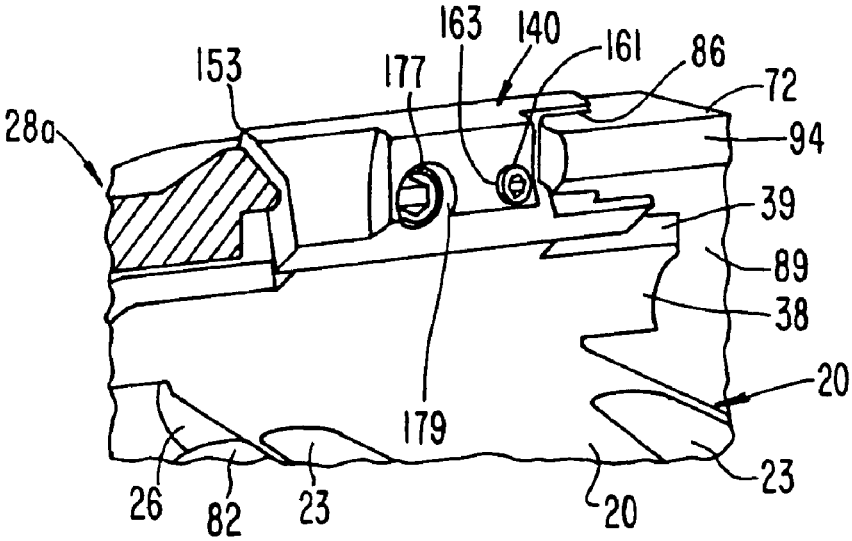
FIG. 16 is a partial rear perspective view, in partial cross section, of the wear assembly of the second embodiment.
Figure 17:
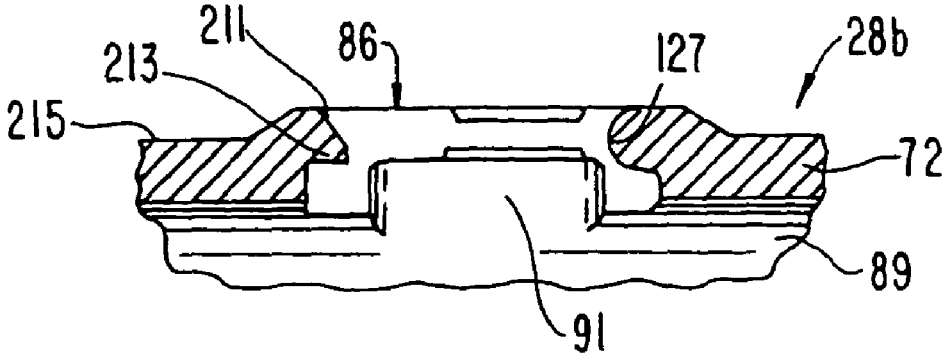
FIG. 17 is a partial rear view of a wear member of a third embodiment.

Pusher 161 and plug 157 are initially retracted to facilitate insertion of lock 140 into aperture 86. Sidewall 149 of lock 140 is, then, fit against sidewall 127 and the lock swung into aperture 86 in the same way as lock 56 (FIG. 15). Once lock 140 is in place (FIG. 16), a wrench is used to turn pusher 161, which in turn, abuts the elastomeric body 165 of plug 157. Advancement of pusher 161 continues so that shell 167 of plug 157 abuts rear wall 52 of support 50 and moves lock body 145 rearward. This movement of lock body 145 pulls shroud 28*a* tightly against front face 48 of boss 20. Pusher 161 is then further tightened to compress elastomeric body 165 so that it will continue to apply a pulling force on shroud 28*a* to maintain a tight fit even after wear begins to develop through use. This compression of the resilient plug member 157 also applies pressure on the threaded pusher member 161 to resist loosening of the pusher during use.

Lock 140 further includes a latch member 177 that is received into a threaded bore 179 in body 145 adjacent bore 163 and pocket 159. Latch member 177 preferably includes a threaded shank portion 181 threaded into bore 179, an unthreaded latching portion 183 that projects forward of front wall 147, and a hex socket 185 or other tool-engaging formation. Nevertheless, latch 177 could be threaded along its entire Length. The latching shank is preferably received in a depression 143 in shroud 28*a* and recess 54 to prevent inadvertent release of lock 140 from aperture 86. Since the latch does not receive the impact loads applied to the wear member 28*a*, it is less inclined to release during use. Further, since it retracts into stem portion 92 of aperture 86, impacted fines should not hinder its rearward movement. Nevertheless, latch member 177 could be altered; e.g., it could be advanced by means other than a threaded shank or it could be received beneath midsection 125 without depression 143 (if made smaller and lower in the lock).

As another alternative, a third lock 190 could be used to secure shroud 28*b* to boss 20*b*. Shroud 28*b* and boss 20*b* are the same as shroud 28 and boss 20 except where differences are noted. Accordingly, the same numbers are used for the same parts.

In addition, lock 190 is the same as lock 140 except for the latch and the omission of the pusher (although the pusher could be included if desired). Instead of latch 177, lock 190 includes an arcuate latch member 193 comprising an elastomeric body 195 composed of rubber or other suitable elastomer, a steel detent member 197 on one end of body 195, and a steel retainer member 199 on the other end of body 195. The components are preferably bonded together by molding or adhesive.

Figure 18:
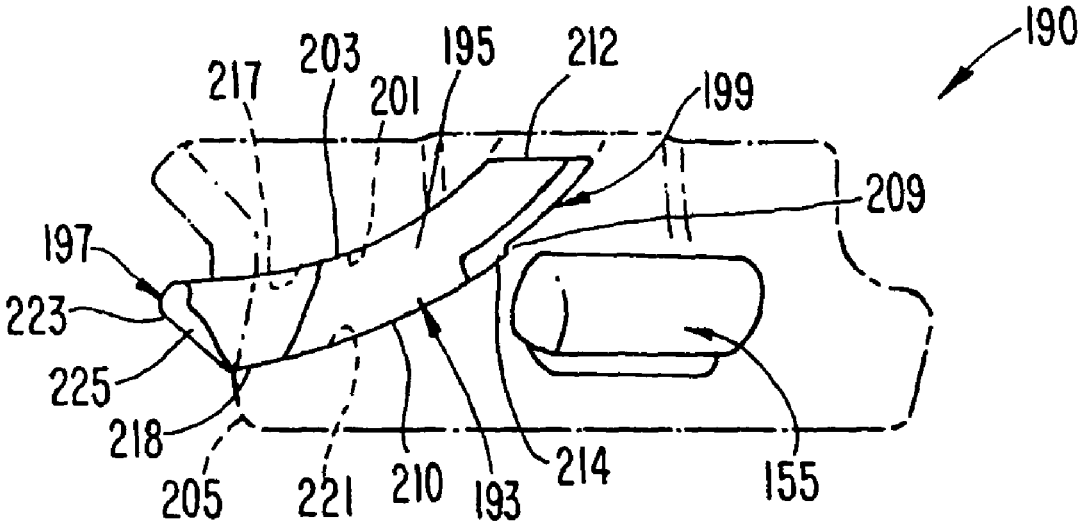
FIG. 18 is a rear perspective view of a lock for the third embodiment with the Lock body shown in phantom.
Figure 19:
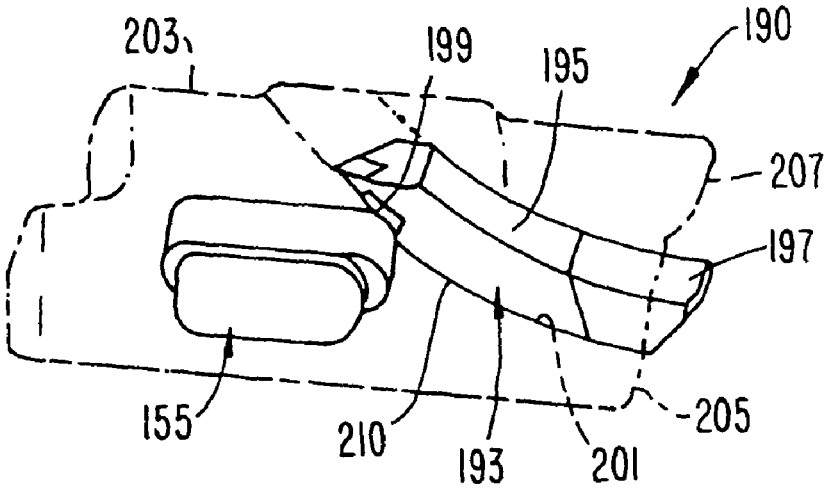
FIG. 19 is a front perspective view of the third embodiment of the lock in accordance with the present invention with the lock body shown in phantom.
Figure 20:
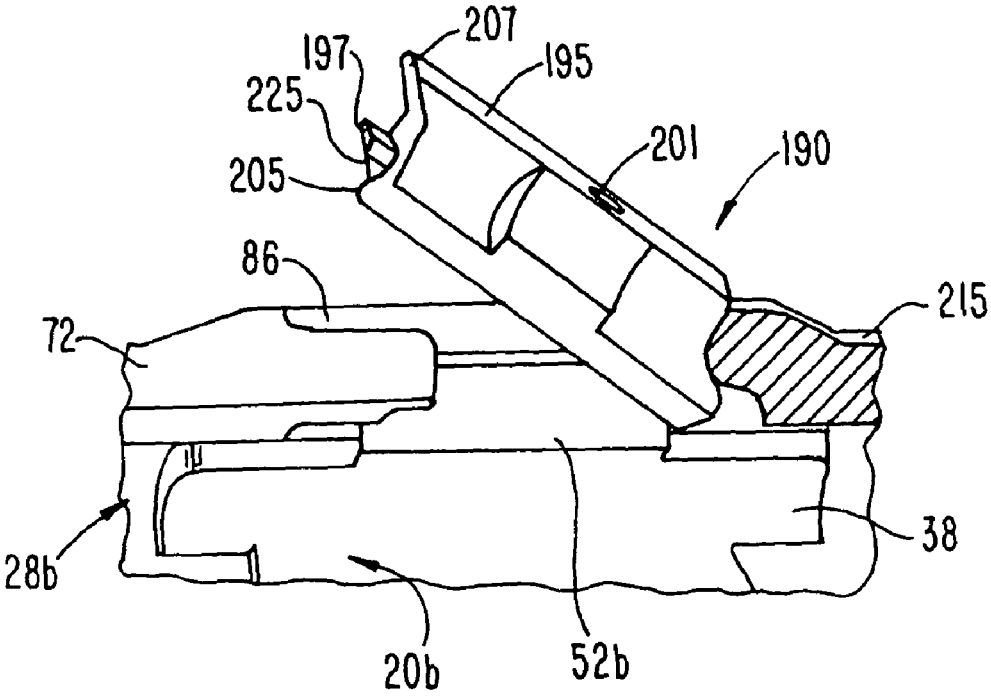
FIG. 20 is a partial rear perspective view, in partial cross section, of the third embodiment of the wear assembly.
Figure 21:
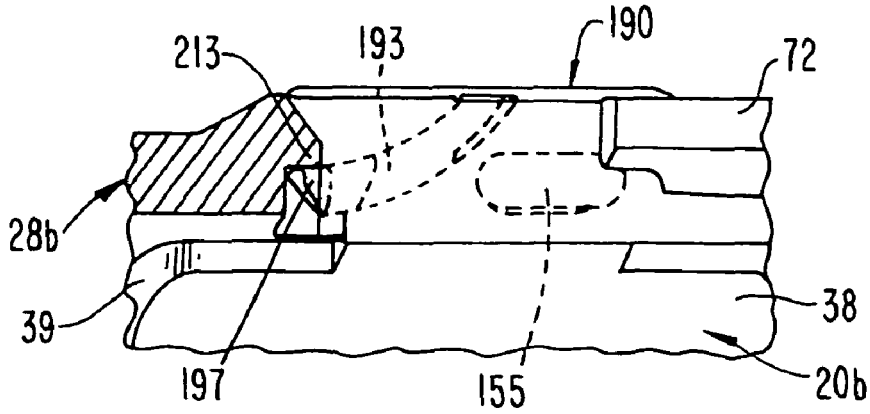
FIG. 21 is a partial rear perspective view, in partial cross section, of the wear assembly with the third embodiment of the wear assembly.
Figure 22:
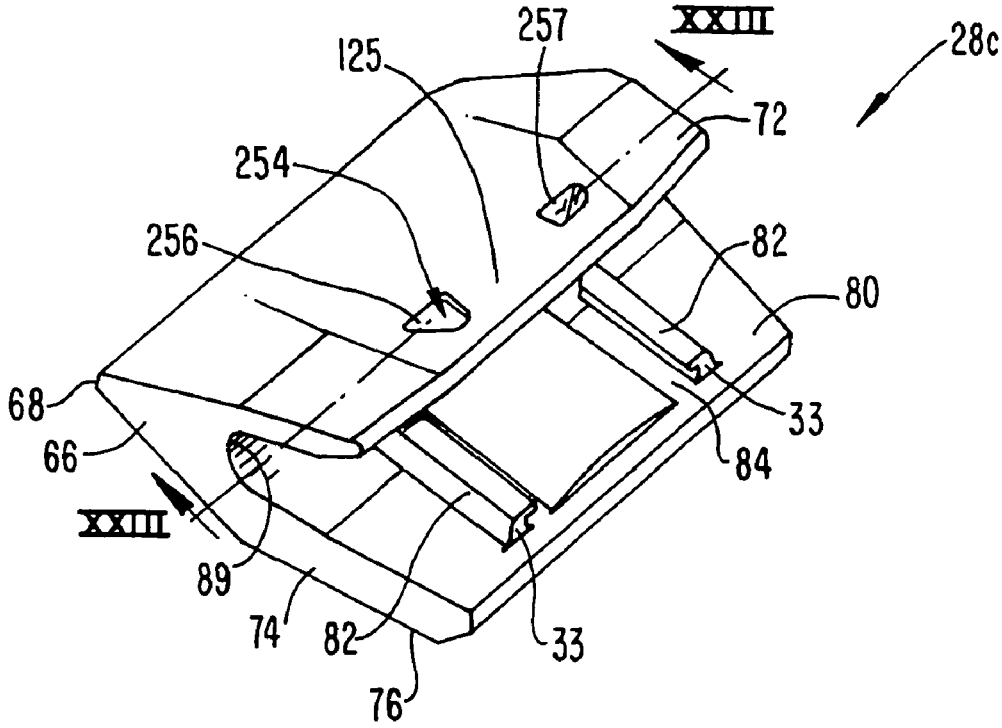
FIG. 22 is a rear perspective view of a fourth embodiment of a wear member.
Figure 23:
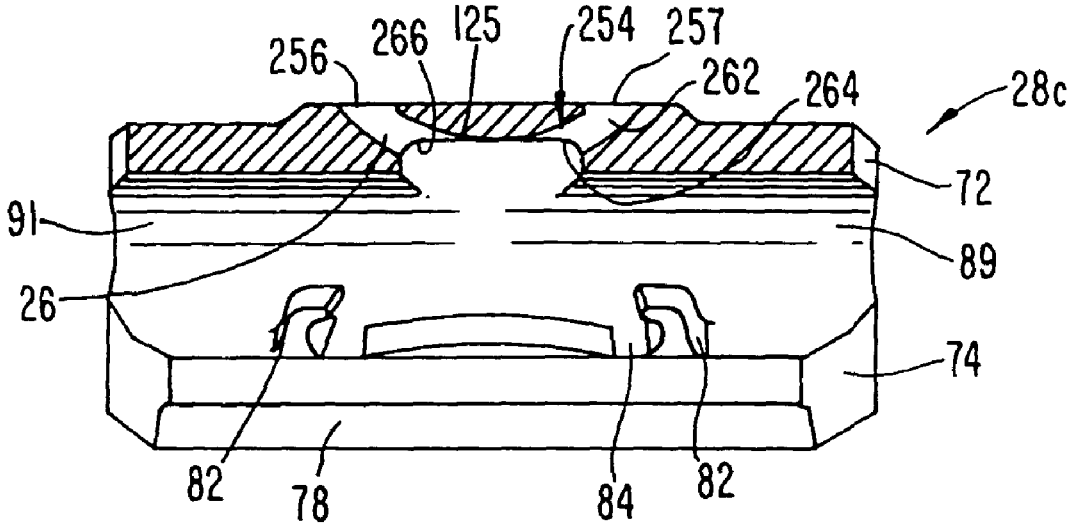
FIG. 23 is a rear view of a wear member, in partial cross section along line XXIII-XXIII in FIG. 22 of the fourth embodiment.

An arcuate passage 201 is formed in body 191 of lock 190 for receiving latch 193 (FIGS. 18-19). Passage 201 preferably extends from top wall 203 to sidewall 205 of lock 190. In this construction, passage 201 opens below tang 207. Passage 201 further includes a shoulder 209 near top surface 203 to cooperate with retainer member 199. Retainer 197 extends along the convex side 210 of the rear end 212 of body 195, and includes a ledge 214 to abut shoulder 209 to retain the latch in the lock.

For use with lock 190, sidewall 211 of aperture 86 includes a keeper 213 along the outer surface 215 of inner leg 72. Keeper 213 preferably sets below tang 207 to form an overhang for detent member 197 of latch 193. In addition, there is no need for recess 54 in support 50. As a result, rear wall 52*b* preferably extends continuously across support 50 without recess 54.

In use, lock 190 is swung into aperture 86 in the same manner as locks 56, 140. Detent 197 preferably has a generally trapezoidal shape, although other shapes are possible. Specifically, detent 197 has an elongate, curved concave side 216 to match the curvature of the upper side 217 of passage 201, and a shorter, curved convex side 218 to match the lower side 221 of passage 201. The free end 223 of detent 197 includes a ramp surface 225 that is inclined outward and upward from sidewall 205 of lock body 191. In this way, ramp surface 225 functions to retract detent 197 within passage 201 against the bias of body 195 to permit passage of latch 193 past keeper 213 as the lock is swung into aperture 86. Once the detent passes keeper 213, the detent will spring back into a latched condition behind the keeper.

To remove the lock for replacement of shroud 28*b*, an operator first disconnects ledge 214 from shoulder 209 and pries Latch 193 rearward slightly with a slender tool (e.g., a screwdriver). At this point, the operator grasps and pulls the Latch rearward so that detent 197 retracts into Lock body 191. Then, the lock can be rotated out of aperture 86 by Lifting tang 207.

As another alternative, shroud 28*c* could be secured to boss 20*b* with a fourth lock 235. Shroud 28*c* and boss 20*b* are the same as shroud 28 and boss 20 except where differences are noted. The same reference numbers are used for the same parts.

Lock 235 includes a steel, elongate, arcuate body 237 provided with first and second pockets 239, 241 to receive a take-up element 243 and a detent 245. The take-up element and detent are each composed of an elastomeric body 247, 248 and a shell 249, 250 bonded together preferably by molding or adhesive. Bodies 247, 248 are preferably secured within pockets 239, 241 by molding or adhesive, but could be secured by other means. Lock body 237 is curved to be received into a passage 254 defined in shroud 28*c* of a corresponding shape. The leading end 255 of body 237 has a reduced cross section as compared to the trailing portion 258. A stop 259 is positioned at the inner end of leading end 255.

Passage 254 has a curved shape that defines two spaced apart openings 256, 257 in the upper surface of inner leg 72. Passage 254 extends through midsection 125 and intersects cavity 91. In the preferred construction, passage 254 includes a first segment 260 to one side of cavity 91 and a second segment 262 to the other side of cavity 91. First segment 260 has a larger cross section than second segment 262 to ease installation and removal of the lock. In the preferred construction, passage 254 is tapered across its length.

Figure 24:
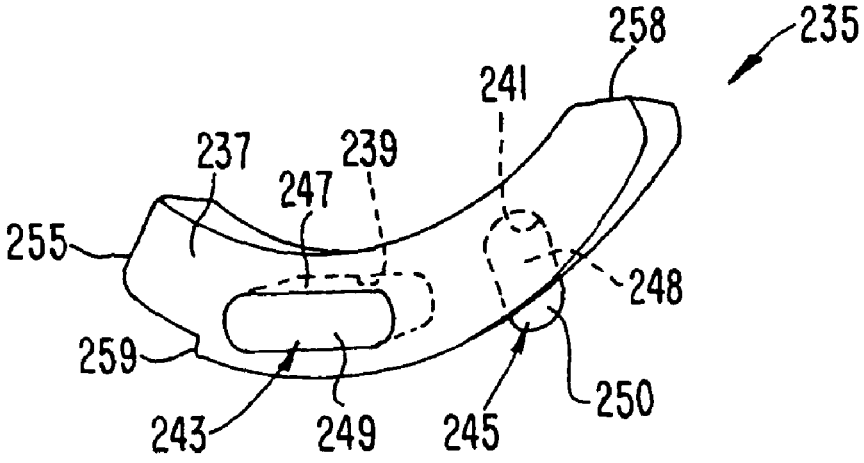
FIG. 24 is a front perspective view of the lock of the fourth embodiment.
Figure 25:
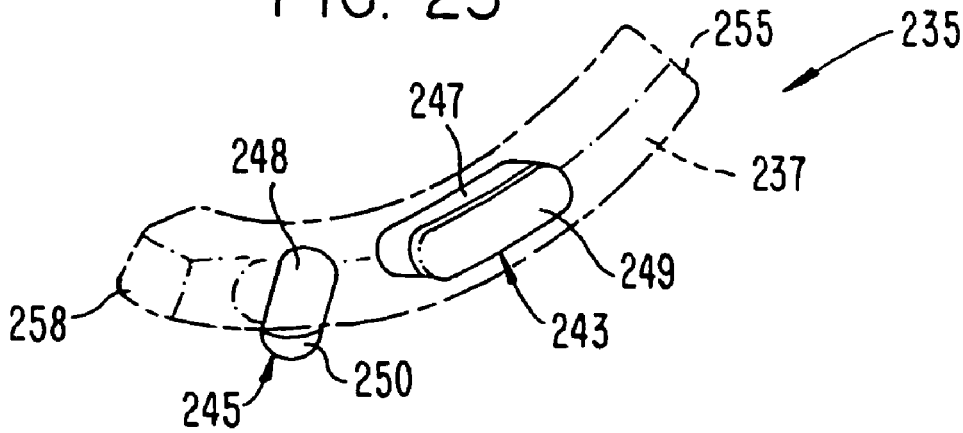
FIG. 25 is a rear perspective view of the lock of the fourth embodiment with the lock body shown in phantom.
Figure 26:
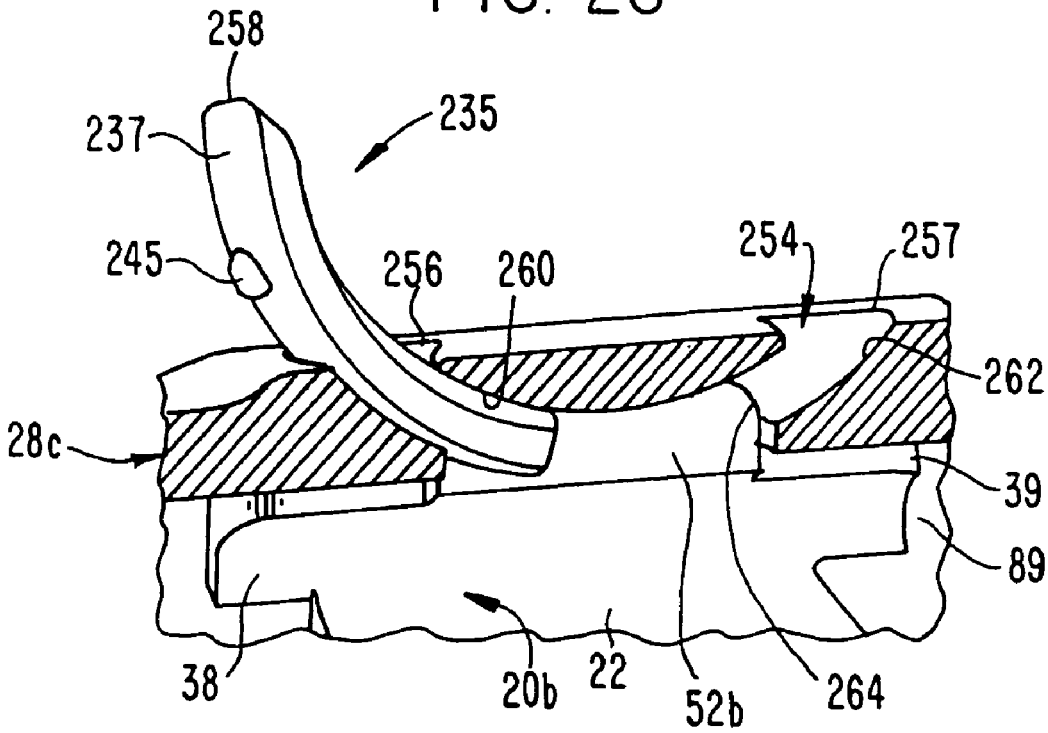
FIG. 26 is a partial cross sectional view of the wear assembly of the fourth embodiment lock taken along line XXIII-XXIII in FIG. 22, with the lock being inserted into the wear member.
Figure 27:
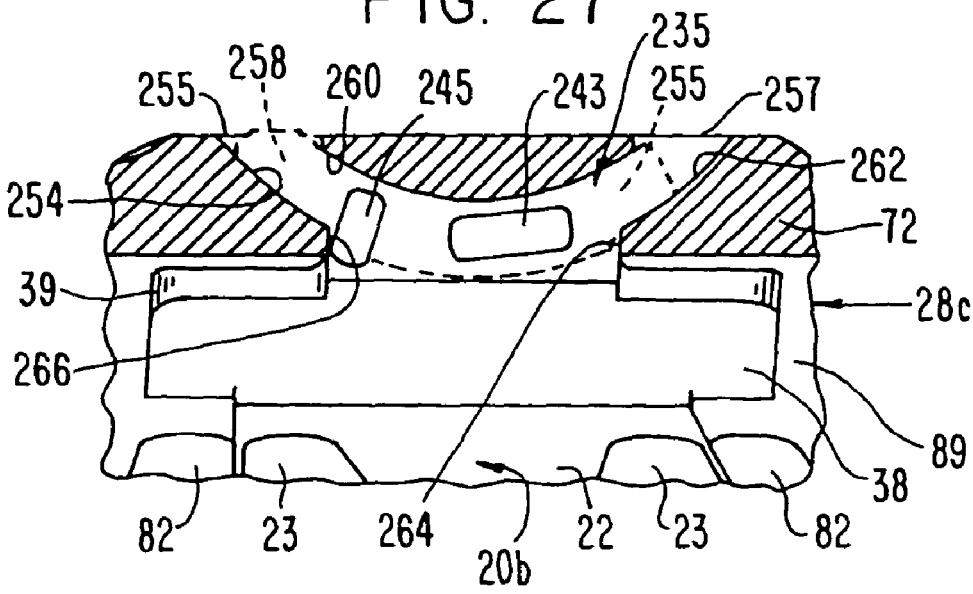
FIG. 27 is a partial cross sectional view of the wear member of the fourth embodiment lock taken along line XXIII-XXIII in FIG. 22, with the lock inserted into the wear member.
Figure 28:
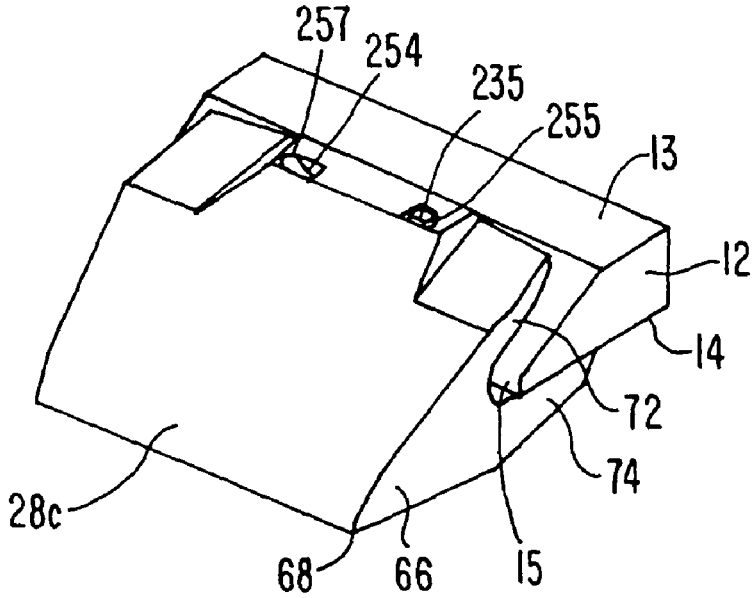
FIG. 28 is a front perspective view of the fourth embodiment of the wear assembly secured to the lip.

In use, once shroud 28*c* has been set onto boss 20*b*, lock 235 is inserted into passage 254. In particular, the leading end 255 is inserted into the first passage segment 260. Since the first segment of the passage is sized to receive the larger trailing portion 257 of body 237, the leading end 255 is initially easily fit within the passage. Lock 235 is driven into the passage by a hammer. Lock body 237 is preferably tightly fit within passage 254 to better resist ejection during use. As lock 235 is driven into passage 254, take-up element 243 and detent 245 are each compressed into body 237 by its contact with the passage walls. Advancement of lock 235 continues until stop 259 abuts the leading edge 264 of second passage segment 262 of reduced cross section. In this position, take-up element 243 and detent 245 are within cavity 91 and naturally expand to their normal projecting positions (as seen in FIG. 24). Take up element 243 projects from the front of body 237 to abut rear wall 52*b* of support 50 of boss 20*b* and pull shroud 28*c* against front face 48 of the boss. Detent 245 extends downward into open space adjacent the trailing edge 266 of first passage segment 260 to function as a stop inhibiting inadvertent release of lock 235 from passage 254. To remove Lock 235, the lock is simply hammered in the reverse direction with the help of a slender toot (not shown) contacting leading end 255.

Locks 56, 140, 190, 235 could be used to secure other kinds of wear members in place, such as adapters or runners. For example, the inventive lock concepts included in tocks 56, 140, 190, 235 could be used to secure such wear members as disclosed in U.S. Pat. Nos. 4,271,615 5,088,214, 5,241,765, and 5,653,048, incorporated herein by reference.

The invention claimed is:

1. A shroud (28) for protecting the front edge of an excavating bucket lip (12), the lip having an inner face (13), an outer face (14), and a boss (20) that wraps around the front edge, the shroud (28) comprising a front working portion (66), and a rear mounting portion (70) bifurcated to define an inner leg (72) and an outer leg (74) to straddle the lip (12) and the boss (20) attached to the lip (12), and a curved inner corner surface (89) joining the legs (72, 74) having a generally uniform curvature to abut a correspondingly curved front part (38) of the boss (20) that wraps around the front edge of the lip (12), the outer leg (74) being longer than the inner leg (72), the inner leg (72) being relatively short and close to the inner face (13) of the lip for reduced impeding of the gathering and dumping of material into and out of the bucket, the inner and outer legs (72, 74) each having an inner surface (80, 87) where the inner surfaces generally face toward each other, the inner surface (87) of the inner leg (72) having a central cavity (91) between the aperture (86) and the inner corner surface (89) for receiving a support (50) upstanding on the inner portion (39) of the boss (20) to abut the lock (56), the inner surface (87) of the inner leg (72) overlying the inner portion (39) of the boss (20) to each side of the cavity (91), and the outer leg (74) having an inner surface (80) including a slot (84) extending rearward of the cavity (91) for receiving an outer portion (22) of the boss (20) and the inner leg (72) having an aperture (86) in general aliment with the central cavity (91) to receive a lock (56) rearward of the inner leg (72) of the boss (20) such that the entire lock is contained substantially within the collective space defined by the aperture (86) and the central cavity (91) to abut a rear wall (52) of distal end of the support (50) on the boss (20) so as to hold the shroud (28) to the boss (20).

2. A shroud (28) in accordance with claim 1 wherein the aperture (86) includes a depression (143) to accommodate a latch component on the lock (156).

3. A shroud (28) in accordance with claim 2 wherein the depression (143) is formed in a front wall (121) of the aperture (86).

4. A shroud (28) in accordance with claim 1 wherein the outer leg (74) includes a rear deflector face (78) that is inclined forwardly away from the lip (12) to direct earthen material away from the shroud (28) during reverse movement of the bucket.

5. A shroud (28) in accordance with claim 1 wherein the slot (84) is formed by a pair of flanges (82) extending from the inner face (80) of the outer leg (74).

6. A shroud (28) in accordance with claim 1 wherein the cavity (91) is defined by an upper inclined wall extending from the inner corner surface (89) to the aperture (86), and a pair of opposite sidewalls opposed to sides of the support (50).

7. A shroud (28) in accordance with claim 1 wherein the inner corner surface (89) extends at least substantially across the entire width of the shroud as a generally uniform curved surface.

8. A shroud (28) in accordance with claim 1 wherein the slot (84) has a generally T-shaped configuration.

9. A shroud (28) in accordance with claim 1 wherein the aperture (86) includes a main portion (90) for receiving a body (101) of the lock (56), and a stem portion (92) that opens in a rear wall (94) of the inner leg (72).

10. A shroud (28) in accordance with claim 9 wherein the aperture (86) includes a rear wall (88) to each side of the stem portion (92) that forms a bearing surface to abut the lock (56).

11. A shroud (28) in accordance with claim 1 wherein the aperture (86) includes an arcuate sidewall (127) to facilitate swinging of the lock (56) into and out of the aperture (86).

12. A shroud (28) in accordance with claim 1 wherein the outer leg (74) includes a rear end (33) to abut a brace (30) on the boss (20).

13. A wear assembly for protecting the front edge of an excavating bucket lip (12), the lip having an inner face (13) and an outer face (14), the wear assembly comprising a boss (20), a shroud (28) in accordance with claim 1, and a lock (56) to hold the shroud (28) to the boss (20).

14. A wear assembly in accordance with claim 13 wherein the boss (20) includes an outer leg (22) with rails (24) extending along the outer face (14) to cooperate with the slot (84) in the outer leg (74), a front part (38) to wrap around the digging front edge of the lip (12), and an inner leg (39) extending along the inner face (13), the inner leg having a support (50) with a rear wall (52) to abut the lock (56).

15. A wear assembly in accordance with claim 14 wherein the front part (38) includes a front face (48) having a uniform curved shape to bear against the inner corner surface (89) of the shroud (28).

16. A wear assembly in accordance with claim 13 wherein the lock (56) includes a body (101) having a threaded bore (109), and a threaded shank (111) received in the bore (109) and which includes a front end (117) to abut the boss (20) to tighten the fit of the shroud (28) against the boss (20).

* * * * *

UNITED STATES PATENT AND TRADEMARK OFFICE

CERTIFICATE OF CORRECTION

PATENT NO. : 7,793,444 B2
APPLICATION NO. : 11/529447
DATED : September 14, 2010
INVENTOR(S) : Larren F. Jones et al.

It is certified that error appears in the above-identified patent and that said Letters Patent is hereby corrected as shown below:

In Column 10, Line 3, change “aliment” to --alignment--.

In Column 10, Line 52, delete the word “digging”.

Signed and Sealed this
Eighth Day of March, 2011

David J. Kappos

David J. Kappos
*Director of the United States Patent and Trademark Office*